US006050671A

United States Patent [19]

Rotering

[11] Patent Number: 6,050,671

[45] Date of Patent: Apr. 18, 2000

[54] STALAGMITE DISSOLVING SPITTOON SYSTEM FOR INKJET PRINTHEADS

[75] Inventor: Catherine Rotering, Vancouver, Wash.

[73] Assignee: Hewlett-Packard Company, Palo Alto, Calif.

[21] Appl. No.: 08/958,625

[22] Filed: Oct. 27, 1997

[51] Int. Cl.[7] ..... B41J 2/165

[52] U.S. Cl. ..... 347/35; 347/36

[58] Field of Search ..... 347/22, 24, 29, 347/34, 35, 36

[56] References Cited

U.S. PATENT DOCUMENTS

| | | | |
|---|---|---|---|
| 5,563,639 | 10/1996 | Cameron et al. | 347/34 |
| 5,617,124 | 4/1997 | Taylor et al. | 347/35 |
| 5,680,162 | 10/1997 | Taylor et al. | 347/35 |
| 5,719,603 | 2/1998 | Nguyen | 347/31 |
| 5,757,395 | 5/1998 | Chew et al. | 347/29 |

*Primary Examiner*—N. Le
*Assistant Examiner*—Judy Nguyen
*Attorney, Agent, or Firm*—Flory L. Martin

[57] ABSTRACT

A spittoon system is provided for avoiding formation of an ink stalagmite during spitting of a pigment-based ink from a first printhead of an inkjet printing mechanism. First, ink is spit from a second inkjet printhead containing a dye-based ink formulation and accumulated in a pool defined by spittoon reservoir having a catch basin. The catch basin is configured to splatter and dissipate the pigment-based ink upon impacting the accumulated pool of ink. The spittoon preferably has funnel-shaped tapering walls that resist collection of the pigment-based ink, to avoid formation of an initial base portion of the ink stalagmite. A method of avoiding formation of such an ink stalagmite, along with an inkjet printing mechanism having such a spittoon system, are also provided.

14 Claims, 3 Drawing Sheets

STALAGMITE DISSOLVING SPITTOON SYSTEM FOR INKJET PRINTHEADS

FIELD OF THE INVENTION

The present invention relates generally to inkjet printing mechanisms, and more particularly to a stalagmite dissolving spittoon system that defeats the stalagmite build-up of pigment-based ink residue in a spittoon of an inkjet printing mechanism that prints with both pigment-based ink and dye-based inks, which do not form stalagmites when spit, with spitting being necessary to clear clogged nozzles of inkjet printheads installed in the printing mechanism.

BACKGROUND OF THE INVENTION

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

As the inkjet industry investigates new printhead designs, the tendency is toward using permanent or semi-permanent printheads in what is known in the industry as an "off-axis" printer. In an off-axis system, the printheads carry only a small ink supply across the printzone, with this supply being replenished through tubing that delivers ink from an "off-axis" stationary reservoir placed at a remote stationary location within the printer. Narrower printheads may lead to a narrower printing mechanism, which has a smaller "footprint," so less desktop space is needed to house the printing mechanism during use. Narrower printheads are usually smaller and lighter, so smaller carriages, bearings, and drive motors may be used, leading to a more economical printing unit for consumers.

To improve the clarity and contrast of the printed image, recent research has focused on improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper, as well as on recently developed specialty coated papers, transparencies, fabric and other media. However, the combination of small nozzles and quick-drying ink leaves the printheads susceptible to clogging, not only from dried ink or minute dust particles, such as paper fibers, but also from the solids within the new inks themselves.

When spitting these new pigment-based inks onto the flat bottom of a conventional spittoon, over a period of time the rapidly solidifying waste ink grew into a stalagmite of ink residue. Other systems used a sponge material in a single spit area, where the color dye-based inks were spit and immediately absorbed into the sponge material. Unfortunately these systems left a dry flat spot on the sponge upon which the pigment-based ink then formed a sludge that eventually grew into an ink residue stalagmite. Eventually, in prototype units, the residue stalagmite grew to contact the printhead, which then either could interfere with printhead movement, print quality, or contribute to clogging the nozzles. Indeed, these stalagmites even formed ink deposits along the sides of the entranceway of prototype narrow spittoons, and eventually grew to meet one another and totally clog the entrance to the spittoon. To avoid this phenomenon, conventional spittoons had to be wide enough, often over 8 mm (millimeters) in width, to handle these high solid content inks. This extra width increased the overall printer width, which then defeated the narrowing advantages realized by using an off-axis printhead system. Thus, it would be desirable to have a spittoon system which defeats ink residue stalagmite build-up without increasing the overall width or cost of the inkjet printing unit.

SUMMARY OF THE INVENTION

According to one aspect of the present invention, a spittoon system is provided for receiving ink spit from first and second inkjet printheads dispensing different ink formulations in an inkjet printing mechanism. The spittoon system includes a reservoir having a catch basin sized to accumulate a pool of ink spit from the first printhead, with the catch basin configured to splatter and dissipate ink spit from the second printhead upon impacting the accumulated pool of ink.

According to yet another aspect of the present invention, a method is provided for purging ink from first and second inkjet printheads dispensing different ink formulations in an inkjet printing mechanism. The methods includes the step of accumulating a pool of a first formulation of ink from the first printhead. In a spitting step, a second formulation of ink is spit from the second printhead into the accumulated pool of ink.

According to a more detailed aspect of the present invention, a method is provided for avoiding formation of an ink stalagmite from purging a pigment-based ink dispensed from a first printhead of an inkjet printing mechanism also having a second printhead dispensing a dye-based ink formulation. The method includes the step of accumulating a pool of the dye-based ink formulation spit from the second printhead. In a spitting step, the pigment-based ink is spit from the first printhead into the accumulated pool of dye-based ink.

According to a further aspect of the present invention, an inkjet printing mechanism may be provided with a spittoon system as described above.

An overall goal of the present invention is to provide an inkjet printing mechanism which prints sharp vivid images over the life of the printhead and the printing mechanism, particularly when using fast drying pigment or dye-based inks, and preferably when dispensed from an off-axis system.

Another goal of the present invention is to provide a long-life spittoon system for receiving ink spit from printheads in an inkjet printing mechanism.

Still another goal of the present invention is to provide a spittoon system that is easily to manufactured, and which provides consumers with a reliable, economical inkjet printing unit.

DETAILED DESCRIPTION OF A PREFERRED EMBODIMENT

Figure 1:
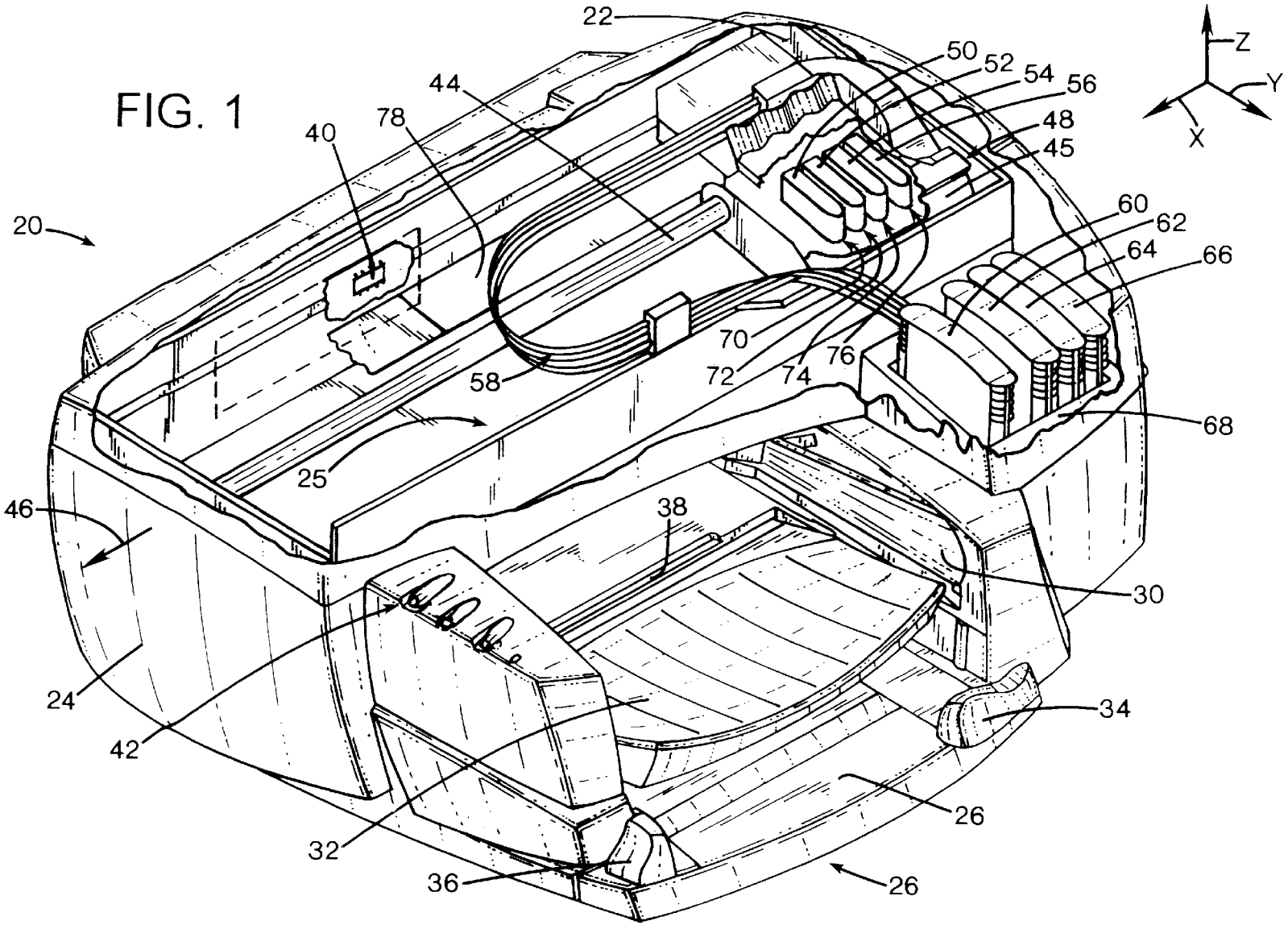
FIG. 1 is a perspective view of one form of an inkjet printing mechanism, here, an inkjet printer, including a printhead service station having one form of a stalagmite dissolving spittoon system of the present invention for servicing inkjet printheads.

FIG. 1 illustrates an embodiment of an inkjet printing mechanism, here shown as an "off-axis" inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a printzone 25 by a media handling system 26. The print media may be any type of suitable sheet material, such as paper, card-stock, transparencies, photographic paper, fabric, mylar, and the like, but for convenience, the illustrated embodiment is described using paper as the print medium. The media handling system 26 has a feed tray 28 for storing sheets of paper before printing. A series of conventional paper drive rollers driven by a stepper motor and drive gear assembly (not shown), may be used to move the print media from the input supply tray 28, through the printzone 25, and after printing, onto a pair of extended output drying wing members 30, shown in a retracted or rest position in FIG. 1. The wings 30 momentarily hold a newly printed sheet above any previously printed sheets still drying in an output tray portion 32, then the wings 30 retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

The printer 20 also has a printer controller, illustrated schematically as a microprocessor 40, that receives instructions from a host device, typically a computer, such as a personal computer (not shown). The printer controller 40 may also operate in response to user inputs provided through a key pad 42 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by the chassis 22 to slideably support an off-axis inkjet pen carriage system 45 for travel back and forth across the printzone 25 along a scanning axis 46. The carriage 45 is also propelled along guide rod 44 into a servicing region, as indicated generally by arrow 48, located within the interior of the housing 24. A conventional carriage drive gear and DC (direct current) motor assembly may be coupled to drive an endless belt (not shown), which may be secured in a conventional manner to the carriage 45, with the DC motor operating in response to control signals received from the controller 40 to incrementally advance the carriage 45 along guide rod 44 in response to rotation of the DC motor. To provide carriage positional feedback information to printer controller 40, a conventional encoder strip may extend along the length of the printzone 25 and over the service station area 48, with a conventional optical encoder reader being mounted on the back surface of printhead carriage 45 to read positional information provided by the encoder strip. The manner of providing positional feedback information via an encoder strip reader may be accomplished in a variety of different ways known to those skilled in the art.

Figure 2:
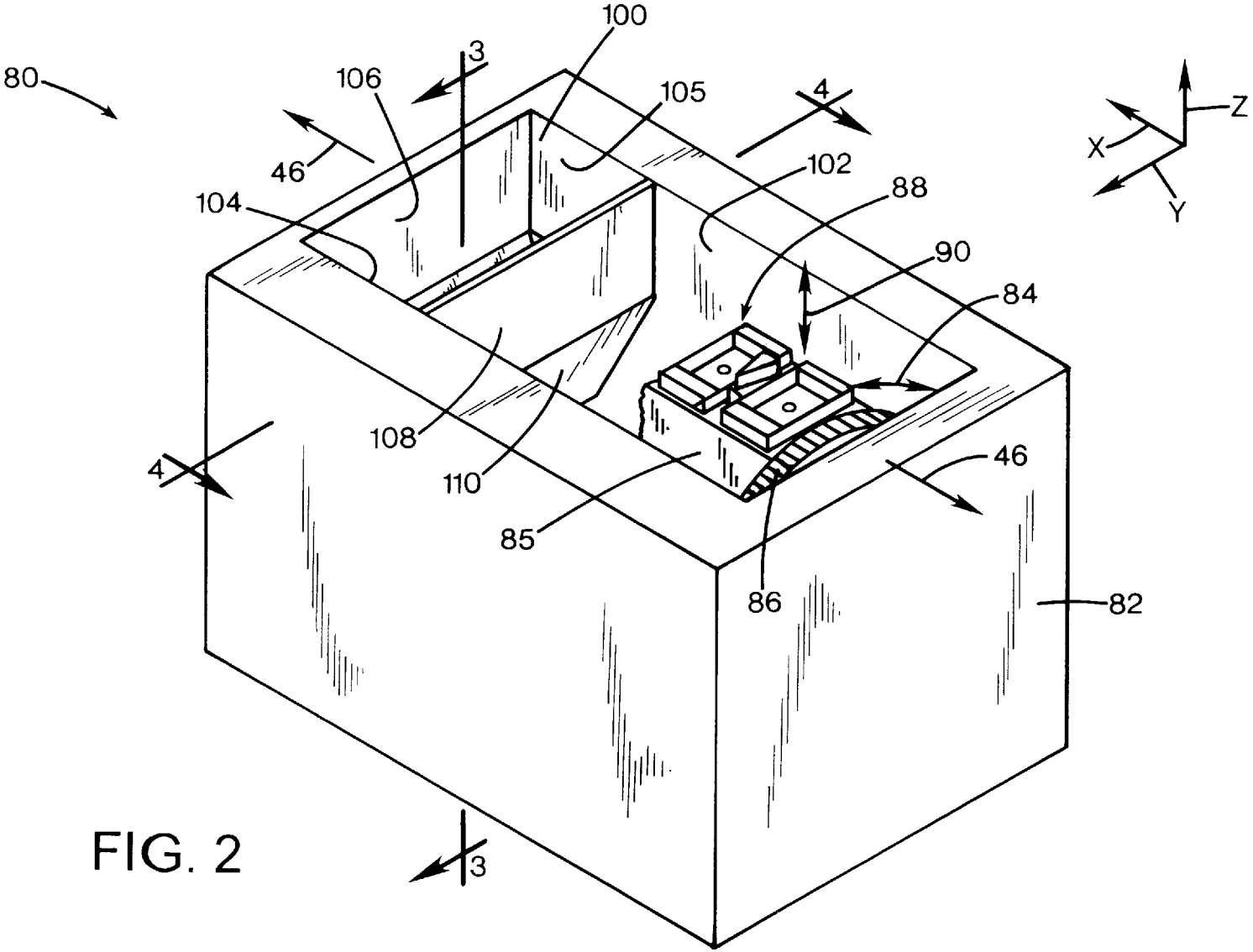
FIG. 2 is a fragmented, perspective view of a service station of the printing mechanism of FIG. 1, including one form of the stalagmite dissolving spittoon.
Figure 4:
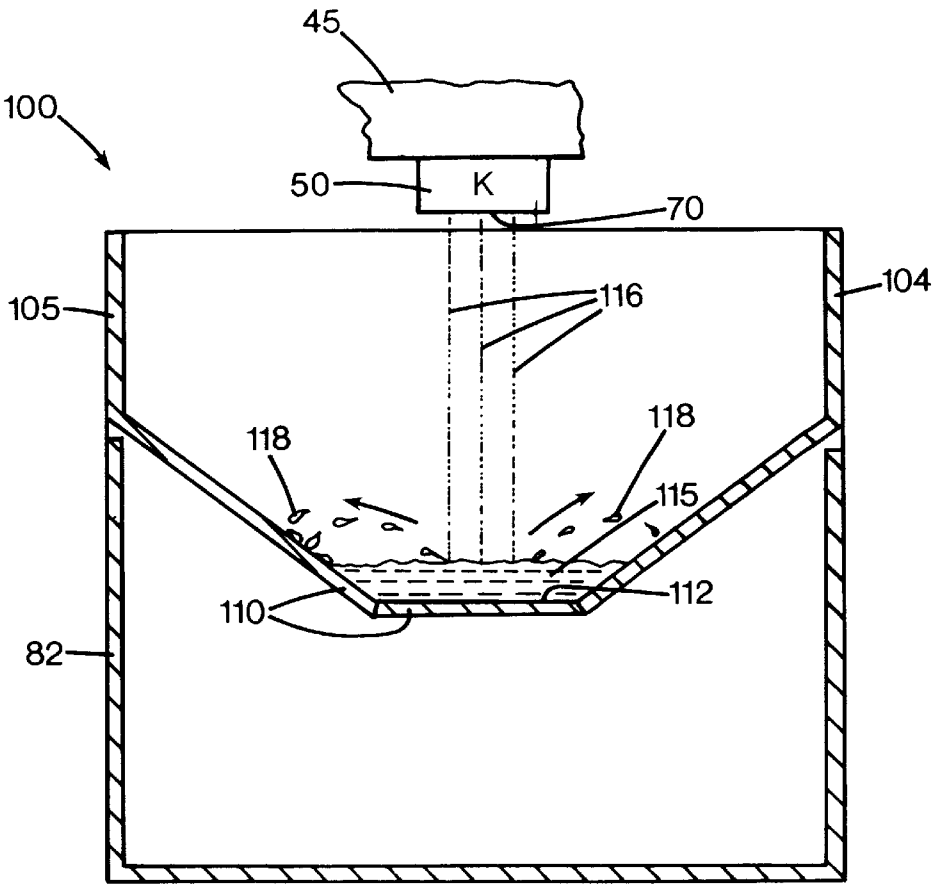
FIG. 4 is a side elevational view taken along lines 4—4 of FIG. 2, shown with a pigment-based black ink printhead in a spitting position.
Figure 3:
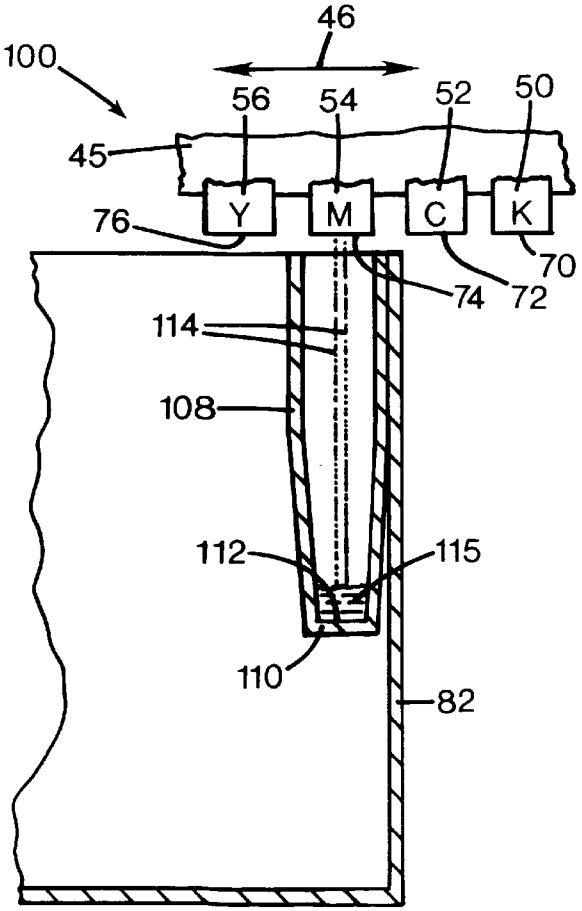
FIG. 3 is a rear elevational view taken along lines 3—3 of FIG. 2, shown with a dye-based color ink printhead in a spitting position.

In the printzone 25, the media sheet 34 receives ink from an inkjet cartridge, such as a black ink cartridge 50 and three monochrome color ink cartridges 52, 54 and 56, shown schematically in FIG. 2. The cartridges 50–56 are also often called "pens" by those in the art. The black ink pen 50 is illustrated herein as containing a pigment-based ink. While the illustrated color pens 52–56 each contain a dye-based ink of the colors cyan, magenta and yellow, respectively. In FIGS. 3 and 4, the cyan pen 52 is also indicated by the letter "C," the magenta pen 54 by the letter "M," the yellow pen 56 by the letter "Y," and the black pen 50 by the letter "K," which are standard color designations in the field of inkjet printing. It is apparent that other types of inks may also be used in pens 50–56, such as paraffin-based inks, as well as hybrid or composite inks having both dye and pigment characteristics.

The illustrated pens 50–56 each include small reservoirs for storing a supply of ink in what is known as an "off-axis" ink delivery system, which is in contrast to a replaceable cartridge system where each pen has a reservoir that carries the entire ink supply as the printhead reciprocates over the printzone 25 along the scan axis 46. Hence, the replaceable cartridge system may be considered as an "on-axis" system, whereas systems which store the main ink supply at a stationary location remote from the printzone scanning axis are called "off-axis" systems. In the illustrated off-axis printer 20, ink of each color for each printhead is delivered via a conduit or tubing system 58 from a group of main stationary reservoirs 60, 62, 64 and 66 to the on-board reservoirs of pens 50, 52, 54 and 56, respectively. The stationary or main reservoirs 60–66 are replaceable ink supplies stored in a receptacle 68 supported by the printer chassis 22. Each of pens 50, 52, 54 and 56 have printheads 70, 72, 74 and 76, respectively, which selectively eject ink to from an image on a sheet of media in the printzone 25. The concepts disclosed herein for cleaning the printheads 70–76 apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

The printheads 70, 72, 74 and 76 each have an orifice plate with a plurality of nozzles formed therethrough in a manner well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 46, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the printzone 25 under the nozzle. The printhead resistors are selectively energized in response to firing command control signals delivered by a multi-conductor strip 78 from the controller 40 to the printhead carriage 45.

Stalagmite Dissolving Spittoon System

FIG. 2 illustrates one form of a service station 80 constructed in accordance with the present invention to service printheads 70–76. The service station 80 includes a frame 82 which is supported by the printer chassis 22 in the servicing region 48 within the printer casing 24. To service the printheads 70–76 of the pens 50–56, the service station 80 includes a moveable platform supported by the service station frame 82. Here, the servicing platform is shown as a rotary member supported by bearings or bushings (not shown) at the service station frame 82 for rotation, as illustrated by the curved arrow 84, about an axis which in the illustrated embodiment is parallel with printhead scanning axis 46. The illustrated rotary member comprises a tumbler body 85 which may have a drive gear 86 that is driven by a conventional service station motor and drive gear assembly (not shown).

The tumbler 85 carries a series of servicing components, such as a capping assembly 88, into position for servicing the printheads 70–76. The cap assembly 88 preferably includes four discrete caps for sealing each of the printheads 70–76, although only a two caps are visible in the fragmented view of FIG. 2. The rotary tumbler 85 may also be mounted to the service station frame 82 for movement in a vertical direction, as indicated by the double-headed straight arrow 90 in FIG. 2, to facilitate capping. Alternatively, the capping assembly 88 may be mounted to the tumbler 85 to move upwardly away from tumbler 85 when moved into contact with the pens 50–56 or the carriage 45, for instance, using the capping strategy first sold by the present assignee, Hewlett-Packard Company of Palo Alto, Calif., in the models 850C and 855C DeskJet® inkjet printers. Other servicing components may also be carried by the rotary platform 85, such as a series of printhead wipers (not shown) for cleaning the printheads 70–76.

FIGS. 2–4 illustrate one form of a stalagmite dissolving spittoon system 100 constructed in accordance with the present invention, here, within an interior portion 102 of the service station frame 82, although it is apparent that spittoon 100 may also be constructed separate from the service station frame 82. Indeed, the spittoon 100 may be located at the opposite end of the printzone 25, that is, to the far left in FIG. 1, opposite the servicing region 48. The spittoon 100 is a reservoir, here, illustrated as a rectangular reservoir having opposing front and rear walls 104, 105, which are linked together by opposing inboard and outboard side walls 106, 108.

The spittoon 100 differs from the earlier flat-bottom spittoons by having a contoured bottom wall 110 which is configured to define a catch basin or pool area 112 which may be circular or of other shapes, but here is illustrated as having a rectangular shape. In the illustrated embodiment, the bottom wall 110 tapers down from the front and back walls 104, 105 and the side walls 106, 108, preferably in a funnel shape. The pool or basin 112 is located directly under the position at which the printheads 70–76 are located during spitting.

In operation, the catch basin 112 of the stalagmite dissolving spittoon 100 advantageously prevents the buildup of ink residue stalagmites which occurred when spitting the black pigment based ink on the earlier flat bottom spittoons. As shown in FIGS. 3 and 4, the color ink is spit during servicing routines into spittoon 100, as illustrated for ink droplets 114 being spit from the magenta printhead 74. During typical servicing, the color pens 52–56 deposit more ink in the spittoon 100 than the black pen 50, which allows a pool or puddle of color ink 115 to accumulate at the bottom of the basin 112. The accumulation of the color ink pool 115 stays liquid during normal operation. Indeed, servicing routines may be organized to form the pool 115 by spitting the color pens 52–56 after extended periods of printer inactivity.

FIG. 4 illustrates spitting of the black pen 50 after accumulation of the color ink puddle 115 in basin 112. In FIG. 4 we see a series of black ink droplets 116 being spit from printhead 70. As illustrated schematically by droplets 118, as the black ink 116 impacts the surface of the ink pool 115, the black ink droplets are dissipated, with some droplets 118 splashing away to the tapered portion of the bottom wall 110. This dissipation of the black ink droplets 116, 118 prevents the formation of an ink residue stalagmite because the black droplets are not allowed to coagulate to begin formation of the base of the stalagmite. It is apparent that over an extended life span of the printer 20, that a stalagmite may eventually form, but use of the color ink pool 115 advantageously delays the beginning formation of such a stalagmite for a good portion, and preferably for a majority, of the life span of the printing unit 20. However, use of a servicing routine that deposits color ink in the basin 112 after periods of printer inactivity may totally prevent a stalagmite from ever forming. Additionally, while the pool 115 is discussed herein as being full of color ink, it is apparent that pool 115 will also include black ink droplets, but the predominant component of pool 115 is liquid color ink from pens 52–56.

Thus, the stalagmite dissolving spittoon system 100 may also be used to illustrate a method of purging two or more inkjet printheads, here four printheads 70–76, with at least two of the printheads containing different formulations of ink, here with the black pen 50 containing a pigment-based ink, and the color pens 52–56 containing color dye-based inks. The method includes the step of accumulating a liquid pool of ink of the first formulation at the bottom of a spittoon reservoir, followed by the step of spitting ink of the second formulation into the accumulated pool of ink of the first formulation. The method also includes the step of dissipating ink of the second formulation upon impact with a surface of the pool of ink of the first formulation to prevent the buildup of undesirable ink residue, and in our particular example, of pigment-based ink residue stalagmites. Preferably, after periods of extended printer inactivity, an initial portion of the servicing routine includes the step of accumulating the pool of color ink 115, through spitting of pens containing the first ink formulation, before spitting the pen containing the second ink formulation, here the black pen 50. Furthermore, it may be desirable to monitor the spitting of the black pen 50 versus the spitting of the color pens 52–56, which may be accomplished using the printer controller 40, to determine whether an excessive amount of black ink 116 has been deposited in the spittoon 100, and whether additional spits of the color ink from pens 52–56 are required to maintain an adequate level of liquid ink 115 in the basin 112.

Conclusion

Thus, a variety of advantages are realized using the stalagmite dissolving spittoon 100, in conjunction with service station 80 in printer 20. For example, only a single spittoon is used to receive ink from both the black color pens 50–56, so additional printer width is not required to provide two separate spittoon systems for handling the black ink separate from color inks. Moreover, the stalagmite dissolving spittoon 100 advantageously prolongs printer life, by totally avoiding in the best case, and substantially delaying in the worst case, the formation of an ink stalagmite. Furthermore, the stalagmite dissolving spittoon 100 is inexpensive to design, procure, and manufacture, leading to a more economical inkjet printing unit 20 for consumers.

I claim:

1. A spittoon system for receiving ink spit from first and second inkjet printheads dispensing different ink formulations in an inkjet printing mechanism, the spittoon system comprising a reservoir having a catch basin which accumulates a pool of liquid ink spit from the first printhead, with the catch basin configured to splatter and dissipate ink spit from the second printhead upon impacting the accumulated pool of liquid ink, wherein the ink spit from the first printhead comprises a dye-based ink formulation, and the ink spit from the second printhead comprises a pigment-based ink formulation.

2. A spittoon system according to claim 1 wherein the catch basin has walls defining a funnel shape.

3. A spittoon system according to claim 1 wherein the catch basin has walls defining a rectangular cross section.

4. A spittoon system according to claim 1 wherein the catch basin has walls defining a flat bottom surface, and side walls tapering toward the flat bottom surface.

5. A method of purging ink from first and second inkjet printheads dispensing different ink formulations in an inkjet printing mechanism, comprising the steps of:

accumulating a pool of a first formulation of ink from the first printhead; and spitting a second formulation of ink from the second printhead into the accumulated pool of ink;

wherein the accumulating step comprises the step of accumulating ink of the first formulation comprising a dye-based ink formulation, and the step of spitting ink of the second formulation comprises spitting a pigment-based ink formulation.

6. A method according to claim 5 wherein the accumulating step comprises the step of spitting ink of the first formulation from the first printhead into a catch basin.

7. A method according to claim 5 wherein the spitting step comprises the step of dissipating ink of the second formulation upon impact with the accumulated pool of ink.

8. A method according to claim 5 wherein the spitting step comprises the step of preventing formation of an ink stalagmite of ink of the second formulation impeding formation of a base portion of said stalagmite.

9. An inkjet printing mechanism, comprising:

a first inkjet printhead dispensing a first formulation of ink comprising a dye-based ink formulation;

a second inkjet printhead dispensing a second formulation of ink comprising a pigment-based ink formulation;

a carriage that reciprocates the first and second printheads through a printzone for printing and to a servicing region for printhead servicing; and a spittoon comprising a reservoir having a catch basin which accumulates a pool of liquid ink spit from the first printhead, with the catch basin configured to splatter and dissipate ink spit from the second printhead upon impacting the accumulated pool of liquid ink.

10. A method of avoiding formation of an ink stalagmite from purging a pigment-based ink dispensed from a first printhead of an inkjet printing mechanism also having a second printhead dispensing a dye-based ink formulation, comprising the steps of:

accumulating a pool of the dye-based ink formulation spit from the second printhead; and spitting the pigment-based ink from the first printhead into the accumulated pool of dye-based ink.

11. A method according to claim 10 wherein the inkjet printing mechanism has a third printhead and a fourth printhead each dispensing dye-based ink formulations, and the accumulating step comprises accumulating a pool of the dye-based ink formulations spit from the third and fourth printheads.

12. An inkjet printing mechanism according to claim 9 wherein the catch basin has walls defining a flat bottom surface, and side walls tapering toward the flat bottom surface.

13. An inkjet printing mechanism according to claim 9 wherein the catch basin has walls defining a funnel shape.

14. An inkjet printing mechanism according to claim 9 wherein the catch basin has walls defining a rectangular cross section.

* * * * *